United States Patent [19]

Peter

[11] Patent Number: 4,472,981

[45] Date of Patent: Sep. 25, 1984

[54] PISTON-DRIVEN BELT CYLINDER

[76] Inventor: Oskar Peter, 26 Travenstein, D-7484 Bingen, Fed. Rep. of Germany

[21] Appl. No.: 257,493

[22] Filed: Apr. 24, 1981

[30] Foreign Application Priority Data

Apr. 30, 1980 [DE] Fed. Rep. of Germany ..... 3016696

[51] Int. Cl.³ ..... F15B 15/02

[52] U.S. Cl. ..... 74/110; 92/137

[58] Field of Search ..... 74/110; 92/137; 403/300, 306

[56] References Cited

U.S. PATENT DOCUMENTS 4,312,432 1/1982 Sugawa ..... 74/110

FOREIGN PATENT DOCUMENTS 2352186 12/1977 France ..... 92/137

*Primary Examiner*—William F. Pate, III

*Attorney, Agent, or Firm*—Kane, Dalsimer, Kane, Sullivan and Kurucz

[57] ABSTRACT

The invention relates to belt cylinders, i.e. piston rodless operating cylinders in which steel belts, in particular, are used in transferring force; even during production, belts of this kind have the negative property of not being sufficiently straight, instead they are bow shaped and this leads to break downs in that the belts either destroy the flanges on the deflecting rollers in a very short time or, if there are no flanges, they run off the rollers; for this reason despite the technical advantages, belt cylinders have not been successful in practice.

A satisfactory operation of these belt cylinders may be achieved if, and only if, the belts which transfer force from the piston to the force pick-up are in absolute alignment.

In order to achieve this, the invention provides that the piston-belt-force pick-up-piston system be preloaded, and that the ends of the belt be secured pivotably in a turnbuckle, so that they may automatically align themselves; moreover, the relationships between diameter, deflecting rollers and belt dimensions are optimized according to the driving force, from the point of view of fatigue strength.

8 Claims, 5 Drawing Figures

PISTON-DRIVEN BELT CYLINDER

The invention relates to a so-called belt cylinder with a fluid driven piston, wherein the force transmission is performed by means of a belt, preferably a steel belt, whereby the belt at each end is running over rollers at the ends of the cylinder and moves a power pick up outside of the cylinder.

It had been shown in that belt cylinders of this type as known, for example, as piston-rodless operating cylinders, from DEPS No. 1293037 or GBPS No. 1192249 have certain disadvantages in particular have operating deficiencies and therefore have hitherto been unsuccessful in practice. One of the more serious disadvantagees of these belt cylinders is the guidance of the belt on the deflecting roller or rollers which must usually be fitted with flanges to prevent the belt from drifting sideways as a result of, among other things, production related non-linearity of the belt, the latter being often bow shaped and therefore failing to align itself. Breakdowns occur, especially over long cylinder length, leading to material destruction, either of the steel belt, the roller or both parts since the belt moves against or onto the flanges. It has been found practically impossible to guide the steel belt on the deflecting rollers because the guide could not be controlled. The result of this was a constant breakdown of the belt cylinders. Futhermore, the assembly of these units required a maximum of accuracy, since the whole system must be in absolute alignment vertically and horizontally. Rigid attachement of the belt is difficult perse and is rendered even more difficult by any bow shape in the belt. Moreover, tensile and compressive loads in the belt, as it is guided over the deflecting rollers, also have a negative effect.

If a belt is to be guided over deflecting rollers, it is essential for the attachement of the belt in or to the piston and the force pick-up to be in absolute alignment and this is extremely difficult to achieve because of the bow shape in the belt. For a satisfactory operation, however, it is also essential for the piston, the power-pick up, the deflecting rollers and the belt or the belts to be in alignment, which heretofore was not possible.

Even if the belts are made of high-grade material, for example chrome steels, loads acting upon them result in a permanent deformation. Additional stresses occur due to flutter which is impossible to avoid at high piston speeds. The result is premature breakage of the belt. For all of these reasons, belt cylinders of these types could not be used in practical application with conventional operating cylinders, despite their advantages.

On the other hand, a sufficiently thin steel belt, as compared with a cable, has the advantage of being able to run over much smaller deflecting rollers, and is therefore particularly suitable for the transfer of power. Futhermore, in the case of a steel belt the sealing problems can be controlled which is another reason for using them. If the smallest possible deflecting rollers are used, the steel band may run close to the outside of the operating cylinder. This means that the cylinder and the cylinder heads may be smaller and the belt may be suspended along the center line of the portion without increasing the size of the heads. These are design principles which cannot be achieved with a cable.

In spite of the use of thin belts, tensile and compressive stresses occur therein as they pass around the rollers at the ends of the cylinder. The following load cases may occur in the cross section of the belt:

1. On the loaded half of the belt
   (a) during deflection over the rollers, the sum of the loading tensile and compressive stresses resulting from the deflection;
   (b) outside of the deflecting rollers, only loading stresses occur.
2. On the unloaded half of the belt;
   (a) on the deflecting rollers, tensile and compressive stresses resulting from deflection of the belt;
   (b) outside the deflecting roller: freedom from stress.

In an operating cylinder of this kind, it is impossible to overcome the tensile stresses with extremely wide and thin belts, unless larger dimensions are accepted, but this greatly reduces the advantages of such a unit and therefore limits its field of application.

An attempt might also be made, for example, to achieve a life span comparable to that obtained with piston-rod cylinders, merely by an adequate enlargement of the diameter of the rollers, but this results in a sharp increase in overall dimensions, and in many cases, for instance bus doors, etc., there is not enough space available. If, as has been already suggested and carried out, cables were used to transfer the power instead of belts, the disadvantages of such a drive device would be even greater due to the installation conditions, since the rollers would have to be larger in diameter than those used for belts, in order to avoid premature wear in cables passing around rollers.

Now various fatigue tests have shown that the diameter of the deflecting rollers must be as small as possible, but only small enough for the maximum tensile and compressive stresses occuring in the unloaded belt to be less than the fatigue strength of the belt under reverse bending loads; and, on the other hand, that the width of the belt for a given thickness must be such that the load imparted by the driving element (the piston) produces, at the most, a stress corresponding to the difference between the fatigue strength under pulsating tensile stress and the reverse bending load.

It is the purpose of the invention to eliminate these disadvantages of belt cylinders and to provide a unit of this kind, the belt or belts of which are controllable between their attachment and suspension points and will run permanently in alignment over the deflecting rollers, the said unit having a long life span, and the belt cylinder, in particular the cylinder heads, being small in dimension as compared with the inside diameter of the cylinder.

According to the invention, this purpose of the invention is achieved in that the system pre-load, with exclusive use of the belt (7) as the spring element, amounts to at least 50% of the possible maximum driving power of the piston (2), wheras the said system pre-load, with the use of at least one spring arranged in the power pick-up in order to apply the pre-load, amounts to up to about 25% of the maximum driving power of said piston, the ends of the said belt being mounted pivotably on the said piston and/or on the said power pick-up, and the deflecting rollers having no flanges.

According to the invention, the required tension is applied by the pre-loaded belt or belts.

According to the invention, the required tension may be applied, as an alternative, by tension springs arranged between the belt or belts.

According to one advantageous embodiment of the invention, the ends of the belts are suspended at the force pick-up in a turnbuckle with pins in sliding parts held at variable distances apart by means of adjustable stops, the said sliding parts being arranged, by means of pins, in alignment in the plane of the belt, and at least one tension spring being provided between the sliding parts with pins.

According to the invention, the system pre-load, with exclusive use of the belt as the spring element, amounts to at least 50% of the possible maximum driving force of the piston, and up to about 25% of the maximum driving force of the piston if the pre-load is produced by spring force.

The ends of the belt are preferably provided with reinforcements.

According to the invention, the pins may also be replaced by a ball and socket joint.

The use in belt cylinders of the device according to the invention allows the belt to adjust itself automatically as it moves back and forth, i.e., to align itself. Any irregularities in the system, especially as regards alignment of the belt between its suspension points, are thus compensated for. A belt under tension loses most of its bow shape.

The belt thus no longer runs against or over the flanges of the deflecting rollers, nor does it run sideways off the rollers if no flanges are provided.

As an element for the transfer of force, the belt, when loaded i.e., when the piston is operated by compressed air and this force is transferred by the belt to the outside by means of the force pick-up, experiences a load from the said force. As a result of this the belt lengthens within the resilient range of the material of which it is made. Slackening of the belt on the unloaded side, resulting in misalignment, is eliminated by the invention in that any lengthening of the belt on the loaded side is always compensated for, on the unloaded side, either by reducing the pre-load by the amount of the said lengthening or by contraction of one or more springs in the turnbuckle.

If the belt is used in the system both as a force transfer element and, conceivably, as a spring element, 50% of the maximum possible driving force is needed as pre-load since, with a smaller pre-load, the unloaded side of the belt cannot compensate for the expansion. A simpler alternative is to produce the pre-load by one or more springs to compensate for lengthening. In this case, the pre-load required is relatively small since it is added to the force produced by the piston.

According to the invention, the load on the belt is made up of the reverse bending load $(0.7 \div 1.25) \cdot a$; the driving element load (piston and cylinder) of about $(0.7 \div 1.25) \cdot c$, and the load imposed by fatigue under pulsating tensile stress, a maximum of $(0.7 \div 1.25) \cdot b$, wherein:

$a = D_{bw}$ = fatigue strength under reverse bending stress (stress deflection for 2.3% failure probability and at least $10^6$ load cycles);

$b = D_{zsch}$ = fatigue strength under pulsating tensile stress (maximum stress for 2.3% failure probality and at least $10^6$ load cycles with minimum stress = 0);

$c = D_{zzsch} - D_{bw}$ for the belt material selected.

As a result of this, optimal use is made of the belt under the types of load occuring and, at the same time, belt life is almost unlimited.

It has been found to be desirable to use high grade chrome steels for the belts.

Belts of sandwich design may also be used for the transfer of force.

Belts of this kind may be in form of sandwiches of steel-plastic-steel, steel-adhesive-steel, steel-rubber-steel, or the like. This can also save space, since the sandwich design permits the use of narrower belts.

Finally, it is desirable to attach the belt to the piston concentrically. This has the advantage of shifting the axes of the rollers by an equal amount towards the axis of the cylinder and thus results in smaller cylinder heads.

It has been found that belt widths of between $\frac{1}{3}$ and $\frac{2}{3}$ of the inside diameter of the cylinder are particularly satisfactory.

According to the invention, the following dimesions may be obtained by making the belt of a high-grade chromium steel, for example, having a fatigue strength ($10^7$) load cycles, 2.3% failure probability) under a pulsating tensile stress of 1150 N/mm$^2$, and a reverse bending stress of $\pm$750 N/mm$^2$:

(a) in the case of a belt cylinder of 40 mm inside diameter for an operating pressure of max.10 bars:
belt dimensions: width 20 mm, thickness 0.15 mm
roller diameter: 55 mm
belt attachement to piston 10 mm off center (b) in the case of a belt cylinder of 80 mm inside diameter for an operating pressure of max.10 bars:
belt dimensions: width 50 mm, thickness 0.25 mm
roller diameter: 90 mm
belt attachement to pistion: 20 mm off center.

The invention is illustrated in particular, and preferred embodiments by reference to the accompanying drawings in which.

Figure 1:
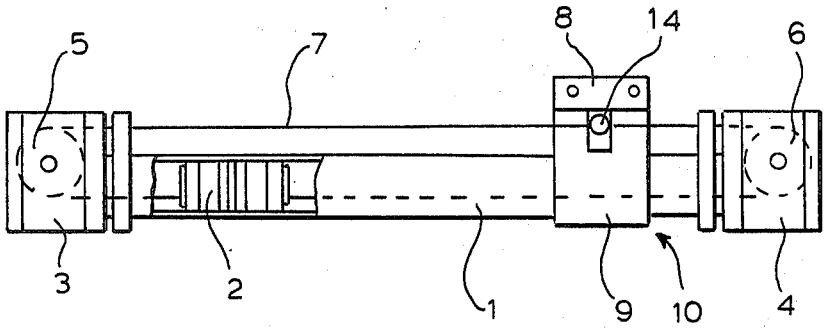
FIG. 1 shows a belt cylinder.
Figure 2:
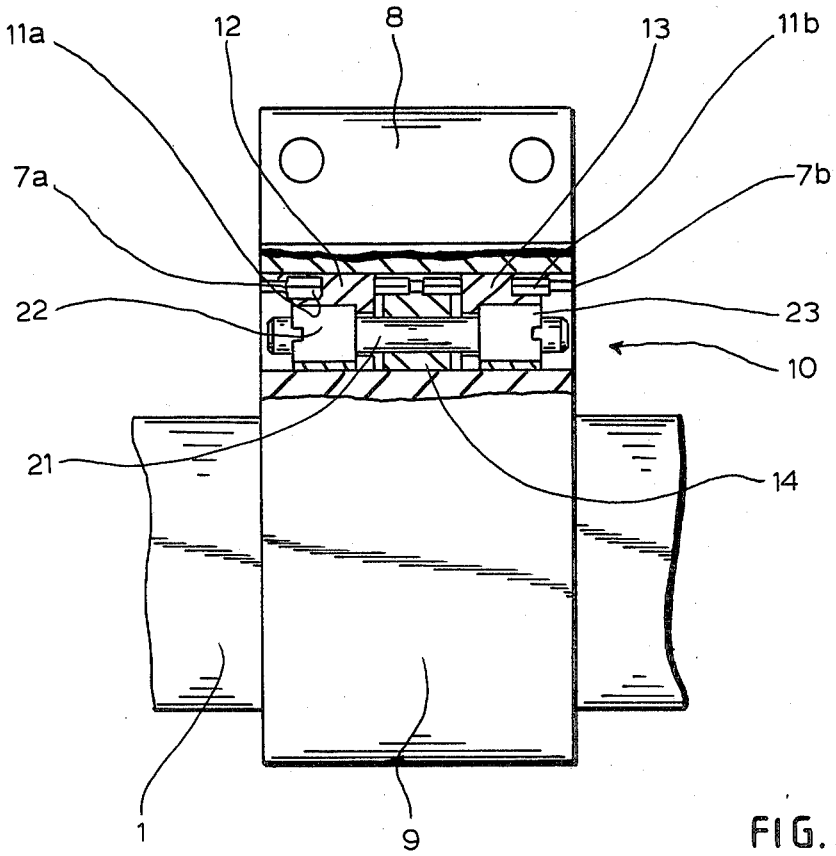
FIG. 2 is a side elevation of detail A in FIG. 1

The belt cylinder illustrated in FIG. 1 consists essentially of a cylinder 1, a piston 2, cylinder heads 3,4, deflecting rollers 5,6 a belt 7 attached to piston 2, running over the deflecting rollers 5,6 and carrying an external force pick-up 8 which may be integral with a guide bushing 9. The transfer of force is effected by piston 2 through belt 7 and stops 22,23 to force pick-up 8.

Belt 7 may either be in one piece, in which case it passes uninterrupted through piston 2, or it may be in two pieces suspended from the left and right hand ends of the portion 2. The belt 7 is in any case divided at force pick-up 8 and is reinforced with strips, tabs, or the like **11*a*, 11*b* which provide the necessary reinforcement around openings in the ends of the belt 7. Ends 7*a*, 7*b* of the belt 7 are suspended, within turnbuckle 10, in the vicinity of force pick-up 8, from pins 12,13 at each end of belt 7, the pins, 12,13 being parts of sliding pieces. In the embodiment in FIG. 1 the two sliding pieces are divided by a drive element 14 and are braced in relation to each other by means of springs 15, 16, spring 15 being hooked to pin 17 in sliding piece 12 and to pin 18 sliding piece 13 is hooked, while spring 16 is hooked to corresponding pins 19,20. Sliding pieces 12,13 and drive element 14 comprise, in addition to holes for springs 15,16 a central hole for a threaded pin 21, or the like, whereby the pin is provided on each side with a stop 22,23 for the sliding pieces 12,13. This makes it possible for the belt 7 to be set to stops 22,23** for the transfer of force, in order to compensate for production and length tolerances.

Figure 4:
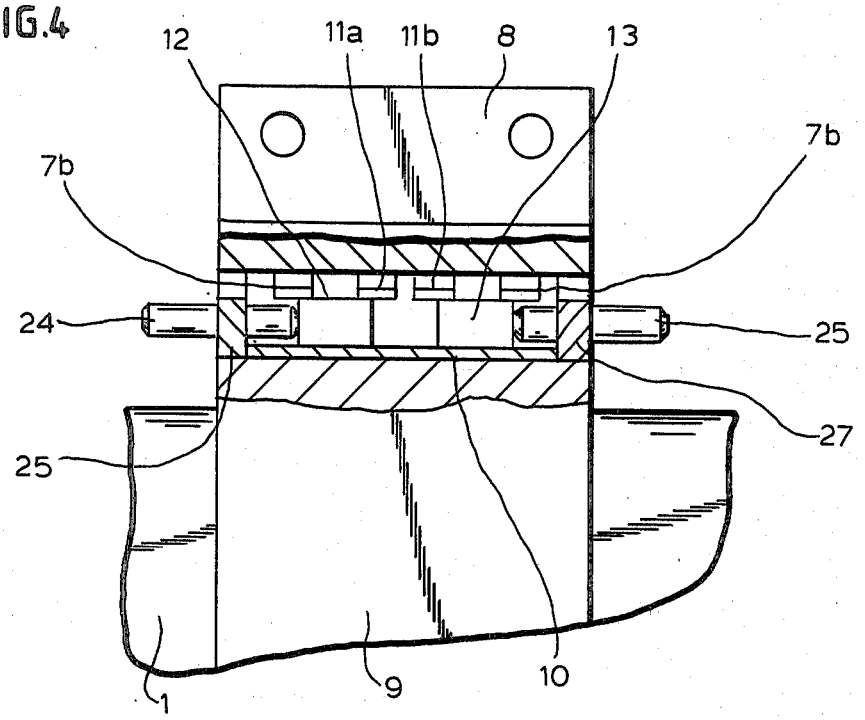
FIG. 4 shows an embodiment of the belt cylinder with no spring.
Figure 3:
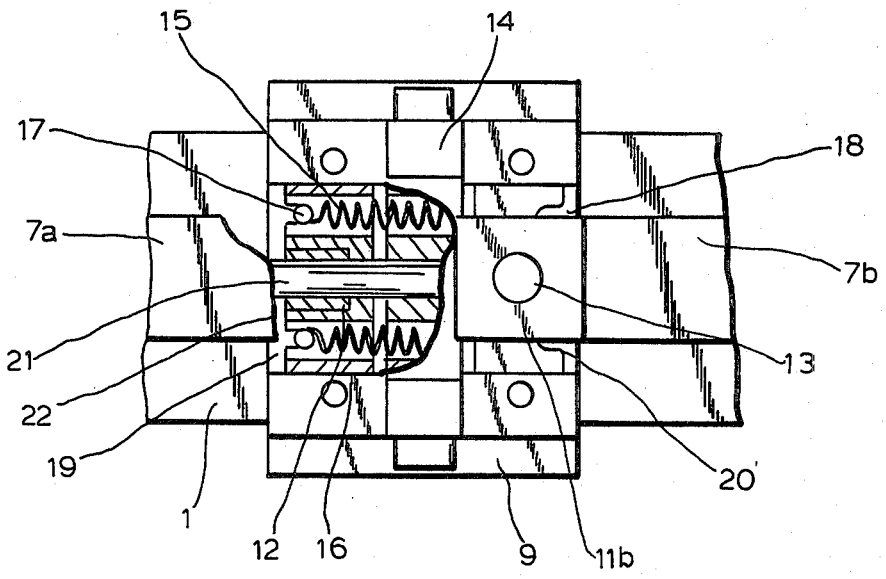
FIG. 3 is a plan view of FIG. 2 in partial section.

FIG. 4 shows a belt cylinder of the invention without springs 15,16, the preload being provided merely by belt 7. Here again, ends *7a,7b* of the belt 7 have openings with straps, tabs or the like, 11*a*,11*b*, from which the sliding pieces 12,13 are suspended by means of pins. In this case, stops 24,25 associated with sliding pieces 12,13 are mounted adjustably in blocks 26,27 rigidly secured to the ends of turnbuckle 10.

Figure 5:
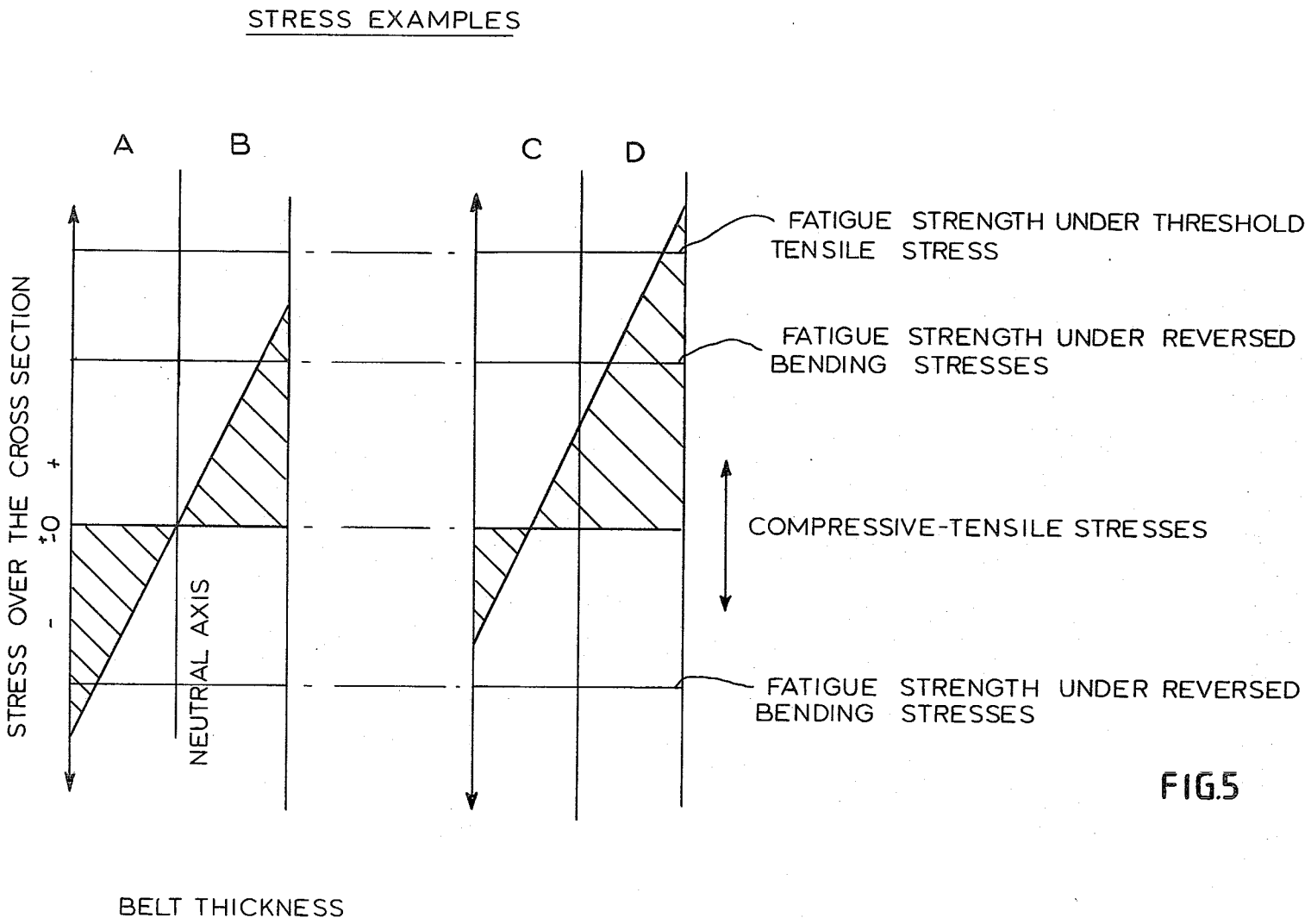
FIG. 5 is a force diagram

Ends *7a,7b* of the belt 7, suspended from the pins in the sliding pieces 12,13 may pivot about these pins and are braced in relation to each other. It has been found that the system preload must be at least 50% of the maximum possible force applied by piston 2, if no springs 15,16 are provided. On the other hand, springs are provided, which makes for simpler assembly, they must be preloaded to a maximum of 25% of the piston force. Belt cylinders of this design operate with no breakdowns for long periods of time, since problems occurring from misalignment of the belt 7 are eliminated. The belt 7 is no longer bow shaped and remains in correct alignment with the connections at force pick-up 8, with deflecting rollers 5,6 and with piston 2 in cylinder 1. The belt 7 does not ride up onto the flanges of the deflection rollers nor, if there are no flanges, does it run off the rollers. Another advantage achieved with the invention is that the assembly of the belt cylinder is quicker and simpler because the belt 7 is fitted in one piece. On the inside of the belt 7, the stress varies between compression according to load cases A and C in FIG. 5, freedom from stress, and stress from cylinder loading, i.e., reverse bending stress is present. The durability of the inside of the belt is thus determined by its fatigue strength under reverse bending stress. If the device is to be adequately durable, the fatigue strength of the belt must provide 97.7% safety against failure under $10^6$ load cycles. In load case A, for example, this is exceeded and fatigue strength is therefore inadequate. On the outside of the belt, the stress varies between no stress at all and tensile stress from the deflection and loading, i.e., there is fatigue occuring from pulsating tensile strength. The durability of the outside of the belt is thus determined by fatigue strength under pulsating tensile stress. In load case D, for example, this is exceeded. Again, fatigue strength would be inadequate.

I claim:

1. a belt cylinder comprising:

a cylinder;

a fluid driven piston disposed within said cylinder;

a pair of rollers without flanges located at each end of said cylinder;

a force-pick up member movably disposed on said cylinder; and a flat belt having two ends and running from said force pick-up member to said piston over said rollers;

said force pick-up member having a turn buckle which holds the two ends at variable distances apart by means of adjustable stops in sliding pieces with pins to tension said belt to at least 25% of the maximum driving force of said piston.

2. The belt cylinder of claim 1 wherein said belt is tensioned to 50% of said maximum driving force.

3. The belt cylinder of claim 1 further comprising springs disposed between said belt ends and said force-pick up to prevent the belt from sagging.

4. The belt cylinder of claim 1 wherein said flat belt is metallic.

5. Belt cylinder according to claim 3 characterized in that the sliding pieces (12,13) are provided with ball and socket joints.

6. Belt cylinder in accordance with claim 1 characterized in that the load on the belt is made up of a reverse bending load $(0.7 \div 1.25) \cdot a$, the driving element load (cylinder and piston) of about $(0.7 \div 1.25) \cdot c$, and the load imposed under fatigue by pulsating tensile stress, a maximum of $(0.7 \div 1.25) \cdot b$, in which:

$a = D_{bw}$ = i.e. repeated loading under reverse-bending stress (stress deflection for 2.3%) failure probality and at least $10^6$ load cycles);

$b = D_{zsch}$ = i.e. fatigue strength under pulsating tensile stress (maximum stress for 2.3% failure probality and at least $10^6$ load cycles with minimal stress $=0$);

$c = D_{zsch} - D_{bw}$ for the belt material selected.

7. Belt cylinder in accordance with claim 1, characterized in that the belt (7) is attached to the piston (2) slighly off center in a direction opposite to its rotation.

8. Belt cylinder in accordance with claim 1, characterized in that the belt (7) has a width amounting to one-third to two-thirds of the inside diameter of the cylinder tube (1).

* * * * *